US009387408B2

(12) United States Patent
Mendelson et al.

(10) Patent No.: US 9,387,408 B2
(45) **Date of Patent: *Jul. 12, 2016**

(54) INTERACTIVE AMUSEMENT ATTRACTION SYSTEM AND METHOD

(71) Applicant: Whitewater West Industries Ltd, Richmond (CA)

(72) Inventors: Aaron Mendelson, Longmont, CO (US); Denise Chapman Weston, Wakefield, RI (US)

(73) Assignee: Whitewater West Industries Ltd., Richmond, BC (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/548,133

(22) Filed: Nov. 19, 2014

(65) Prior Publication Data

US 2015/0141163 A1 May 21, 2015

Related U.S. Application Data

(60) Provisional application No. 61/906,329, filed on Nov. 19, 2013.

(51) Int. Cl.
*A63G 21/18* (2006.01)
*A63G 33/00* (2006.01)

(52) U.S. Cl.
CPC ..... *A63G 21/18* (2013.01); *A63G 33/00* (2013.01)

(58) Field of Classification Search
CPC ..... A63G 21/18
See application file for complete search history.

(56) References Cited

U.S. PATENT DOCUMENTS

| | | | | |
|---|---|---|---|---|
| 6,375,578 | B1 | 4/2002 | Briggs | |
| 6,527,646 | B1 | 3/2003 | Briggs | |
| 7,905,790 | B2 * | 3/2011 | Schnuckle | A63G 31/16 472/43 |
| 7,967,692 | B2 | 6/2011 | Werner | |
| 8,079,916 | B2 | 12/2011 | Henry | |
| 2007/0087850 | A1 | 4/2007 | Henry et al. | |
| 2008/0293470 | A1 * | 11/2008 | Proud | A63F 9/24 463/9 |
| 2009/0143155 | A1 * | 6/2009 | Werner | A63G 21/18 472/117 |
| 2009/0197740 | A1 * | 8/2009 | Julskjaer | A63B 9/00 482/35 |
| 2014/0135137 | A1 | 5/2014 | Heaven et al. | |
| 2015/0133229 | A1 | 5/2015 | Weston et al. | |

FOREIGN PATENT DOCUMENTS

| | | |
|---|---|---|
| CA | 2870805 | 5/2015 |
| WO | 2014075027 | 5/2014 |

* cited by examiner

*Primary Examiner* — Michael Dennis
(74) *Attorney, Agent, or Firm* — Greenberg Traurig

(57) ABSTRACT

A waterslide attraction configured to display illuminated visualizations to a rider traveling thereon via one or more lights or LEDs. The waterslide attraction utilizes a slide for supporting a rider, either with a ride vehicle or without. The ride vehicle may be a mat, tube, or board with interactive elements, such as buttons, that allows the rider thereon to manipulate the interactive elements for providing rider input while on the slide. Upon manipulating an element, a signal may be transmitted, the illuminated visualizations being modified in response to such manipulations. Colors, shapes, and/or patterns may be displayed that animate or appear to shift or move in position along the waterslide. Gaming features, such as manipulating the interactive elements that corresponds to one or more displayed illumination visualizations may cause rewards or penalties, for example, based on position of the rider, as the rider travels on the slide.

13 Claims, 10 Drawing Sheets

INTERACTIVE AMUSEMENT ATTRACTION SYSTEM AND METHOD

CROSS REFERENCE TO RELATED APPLICATIONS

This application claims the benefit of U.S. Provisional Patent Application Ser. No. 61/906,329, filed on Nov. 19, 2013, entitled "ILLUMINATED WATERSLIDE SYSTEM AND METHOD FOR INCORPORATING RIDER SKILL OR REFLEXES," which is hereby incorporated by reference in its entirety.

BACKGROUND

1. Field of the Invention

The present invention relates to a method and system for a waterslide that encourages active participation while riding. More particularly, the present invention relates to a method and system for an illuminated waterslide that visually responds to a rider's input while the rider rides on the waterslide.

2. Description of the Related Art

Waterslide attractions typically provide riders with a thrilling experience of speed and lateral force upon the body as the riders slide on the attraction. A stream of water is commonly flowed along a chute (such as a flume or a tube) from an entrance location of higher elevation to an exit location of lower elevation. A rider slides along the chute due to the stream of water, either with or without a ride vehicle, and experiences the twists, turns, and drops predetermined by the design of the chute. While such attractions provide an initial rush of excitement, repeated riding of the attraction can have diminished appeal as riders become accustomed to the layout of the attraction and their merely passive interaction along its length.

Some concepts or designs have attempted to increase the excitement of a waterslide attraction even after multiple riding attempts. One such concept allowed riders to choose among a collection of preset themes prior to riding on an attraction, the lighting and sound effects changing as the rider traveled down the slide according to the theme chosen by the rider. Depending on the number of selectable themes, riders could have a different experience in subsequent ride attempts. Another concept involved adding elements of competition between two riders via a pair of parallel water slide riding surfaces. These riders could compete with one another on these riding surfaces while non-ride participants could interact with the ride to aid or hinder the rider movement from platforms positioned adjacent to the riding surfaces. Unfortunately, while these designs may have extended rider excitement more so than conventional water slides without such features, they may not have the effect of encouraging multiple attempts at riding the water attraction since riders only passively engage with the waterslide and its features.

Thus, an improved waterslide that incorporates skill or reflexes of the rider themselves while navigating the water slide is desired. The improved waterslide would ideally be capable of tracking user performance, either through the use of a ride vehicle or without, and generate an indication of user performance for encouraging multiple attempts at the waterslide to garner improved performance ratings. The improved waterslide would desirably promote competition between riders, even when such riders are not riding on the waterslide at substantially the same time. Moreover, the improved waterslide would desirably allow riders to gauge or analyze their own performance for improving subsequent runs down the waterslide attraction.

SUMMARY

An amusement attraction that is configured to incorporate rider skill or reflexes is disclosed, for example by tracking/determining a position of a rider on the amusement attraction such that the rider may interact with components of the attraction when within a distance of the various components (e.g., targets). In one embodiment, a waterslide may include a slide having a surface for supporting a flow of water thereon, at least one light connected with the slide and configured to illuminate, a ride vehicle configured to support at least a portion of a rider and travel on the surface of the slide via the flow of water, an interactive element connected with the ride vehicle and configured to be manipulated by the rider to provide rider input, and a reward component configured to be activated to reward the rider based on the rider input.

In another embodiment, a waterslide may include a slide having a surface for supporting a flow of water thereon, at least one light coupled with the slide and configured to illuminate, an interactive element configured to be manipulated by a rider to provide rider input, and a reward component configured to be activated to reward the rider based on the rider input.

In still another embodiment, a method for modifying a visual illumination of a waterslide in response to user input may include displaying a visual illumination along a surface of a waterslide, displaying a target viewable by a user riding on the surface of the waterslide, determining if input received from the user is activated within a predetermined time, and initiating a reward response if the input received from the user is determined to be activated within the predetermined time.

BRIEF DESCRIPTION OF THE DRAWINGS

The features, objects, and advantages of the present invention will become more apparent from the detailed description set forth below when taken in conjunction with the drawings, wherein:

FIG. 1A-2 shows a cross-sectional view of a waterslide clam-shell capable of visual illumination according to an embodiment of the present invention;

FIG. 2 shows a perspective view of a plurality of clam-shell halves of a waterslide capable of visual illumination according to an embodiment of the present invention;

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figures 1, 1A:
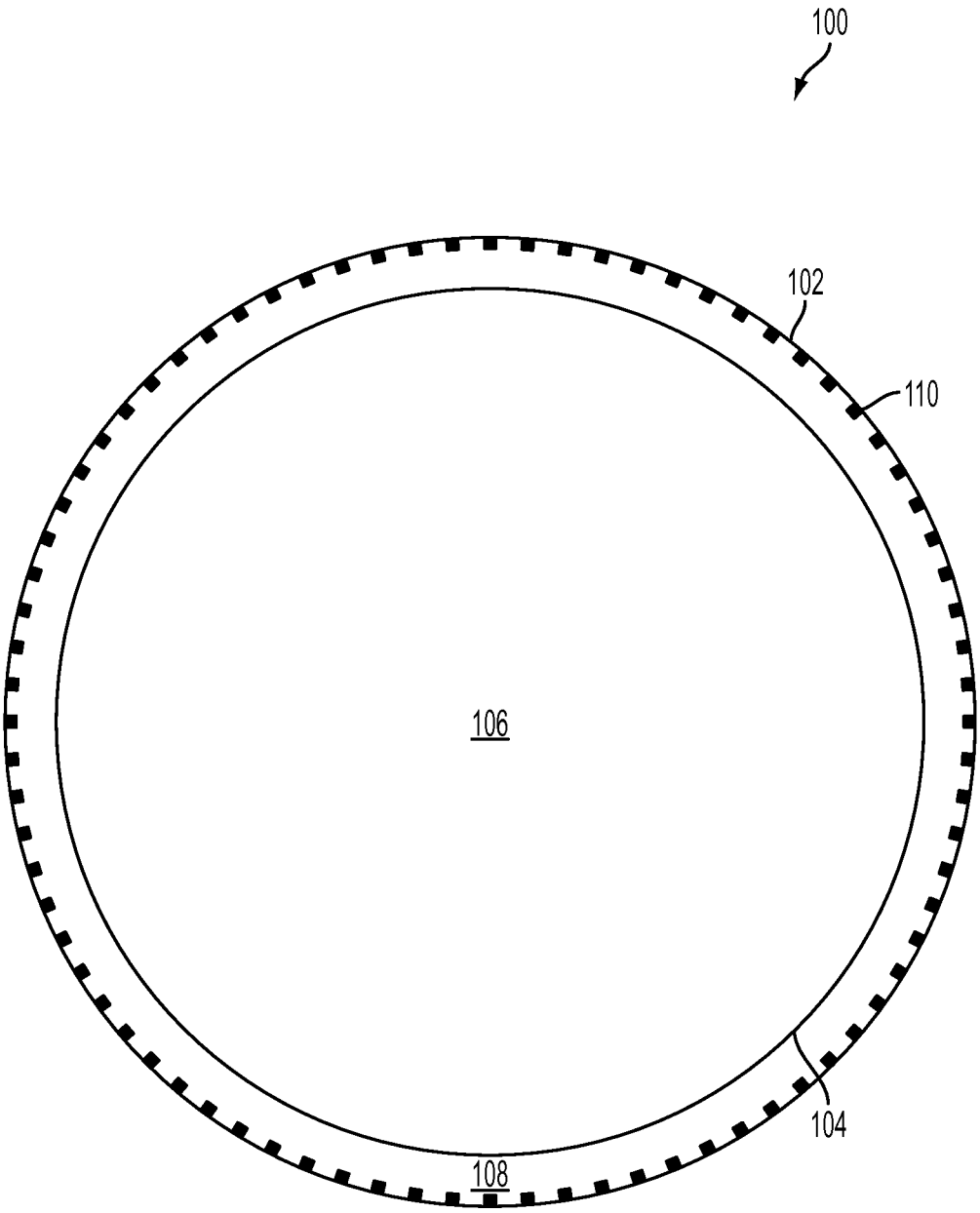
FIG. 1A-1 shows a cross-sectional view of a waterslide clam-shell capable of visual illumination according to an embodiment of the present invention.

Turning first to FIG. 1A-1, a cross-sectional view of a waterslide clam-shell 100 capable of visual illumination is shown. The waterslide clam-shell 100 may be formed of an outer surface or material 102 and an inner surface or material 104. A volume or space 106 positioned within the inner surface or material 104 provides an area where a rider can ride the waterslide (e.g., by sliding on the inner surface or material 104 via a flow or volume of water). A volume or space 108 positioned between the outer surface or material 102 and the inner surface or material 104 may be used for the positioning of one or more lights 110 (e.g., light emitting diodes ("LED") or LED strips) that is/are configured to illuminate. Such volume or space 108 may be created, for example, if the inner surface or material 104 is a transparent or semi-transparent tube that provides a sliding surface for a rider and the outer surface or material 106 provides a mounting surface for the lights 110. In this manner, a rider that is riding the waterslide in the volume or space 106 can see the visual illuminations provided by the lights 110 as they ride along the waterslide. In certain embodiments, individuals that are not presently riding the waterslide clam-shell 100 may also witness the visual illuminations provided by the lights 110. The lights 110 may be coupled to the outer surface or material 102 (as shown), or coupled to the inner surface or material 104 (see FIG. 1A-2), or disposed within the volume or space 108 between the inner material and outer material.

Figures 1, 1A, 2:
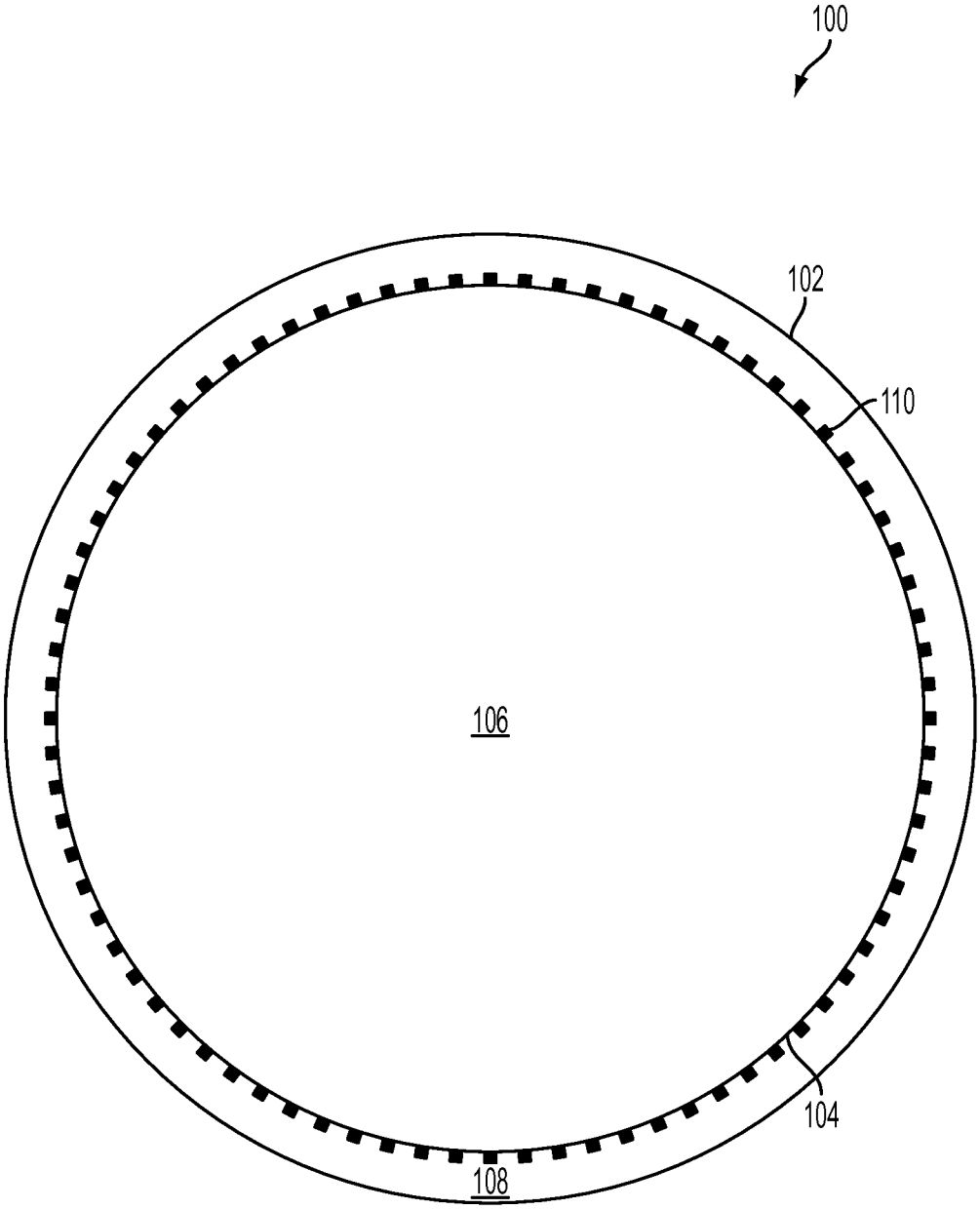
Figure 1B:
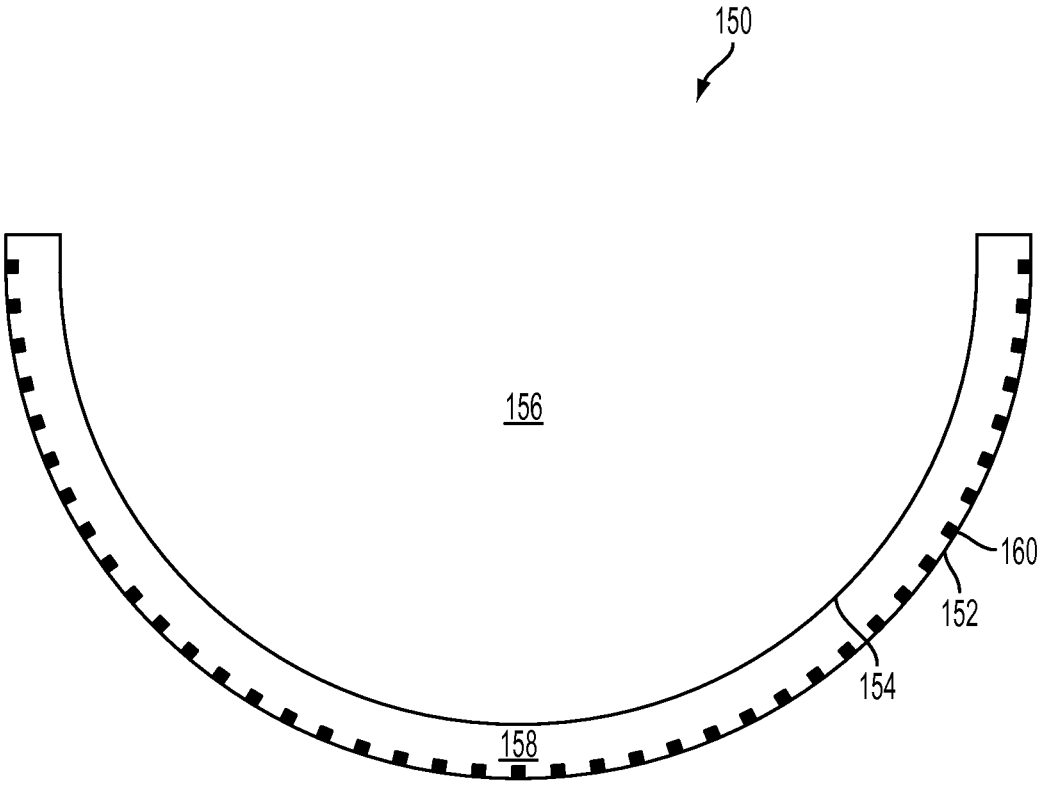
FIG. 1B shows a cross-sectional view of a waterslide clam-shell half capable of visual illumination according to an embodiment of the present invention.
Figure 2:
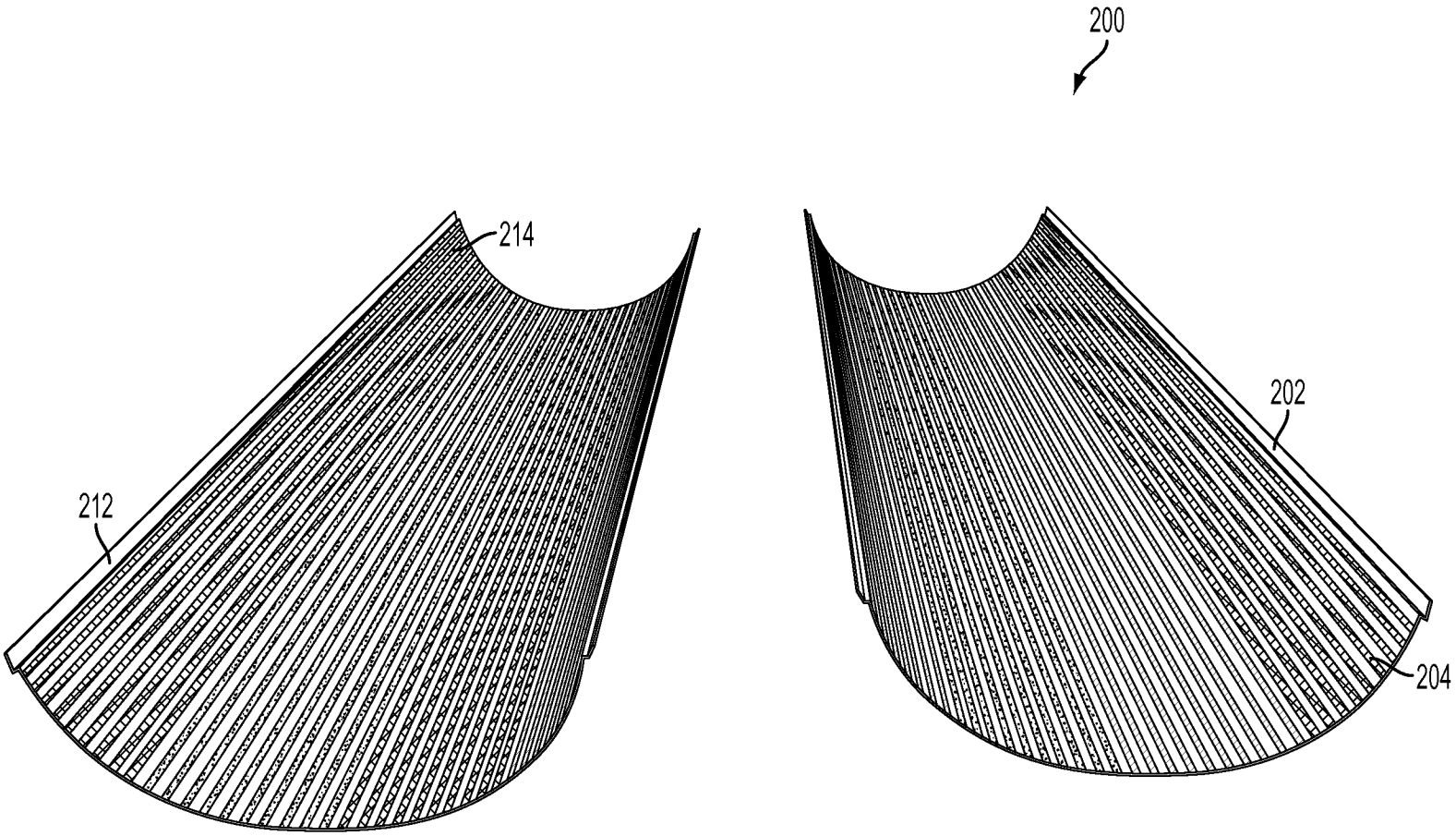

FIG. 1B similarly shows a cross-sectional view of a waterslide clam-shell half 150 that is capable of visual illumination. Like the previous description for the waterslide clam-shell 100 of FIGS. 1A-1 and/or 1A-2, an outer surface or material 152 and an inner surface or material 154 may form a volume or space 158 wherein one or more lights 160 (LEDs or LED strips) are disposed and configured to illuminate. As a rider rides in a volume of space 156 formed via the inner surface or material 154, the rider can see the visual illuminations provided by the lights 160 as they ride along the waterslide. Similarly, the lights 160 may be coupled to the outer surface or material 152 (as shown), or coupled to the inner surface or material 154, or disposed within the volume or space 158 between the inner material and outer material (not shown). The waterslide of FIGS. 1A-1 and/or 1A-2 fully encapsulates or surrounds the rider while the waterslide of FIG. 1B only partially encapsulates or surrounds the rider. In some embodiments, a waterslide may be created that uses both the clam-shell 100 and the clam-shell half 150 in the water waterslide at different portions or areas.

FIG. 2 shows a perspective view of a plurality of clam-shell halves of a waterslide 200 capable of visual illumination. A first clam-shell half or portion 202 includes a plurality of LEDs or lights 204 (e.g., arranged in longitudinal strips down the clam-shell half 202). Similarly a second clam-shell half or portion 212 includes a plurality of LEDs or lights 214 (e.g., arranged in longitudinal strips down the clam-shell half 212). In one embodiment, the first clam-shell half or portion 202 and the second clam-shell half or portion 212 may be fit together to form a substantially 360 degrees tube that can visually illuminate a sliding surface of a waterslide. As illustrated, a variety of colors may be displayed by the plurality of LEDs or lights 204 and/or 214. As described in greater detail below, the colors displayed by the plurality of LEDs or lights 204 and/or 214 (or the illumination of the LEDs or lights 204 and/or 214 at all) may be varied with time so as to create the appearance of animating, shifting, changing, or moving lights to the rider.

Figure 3:
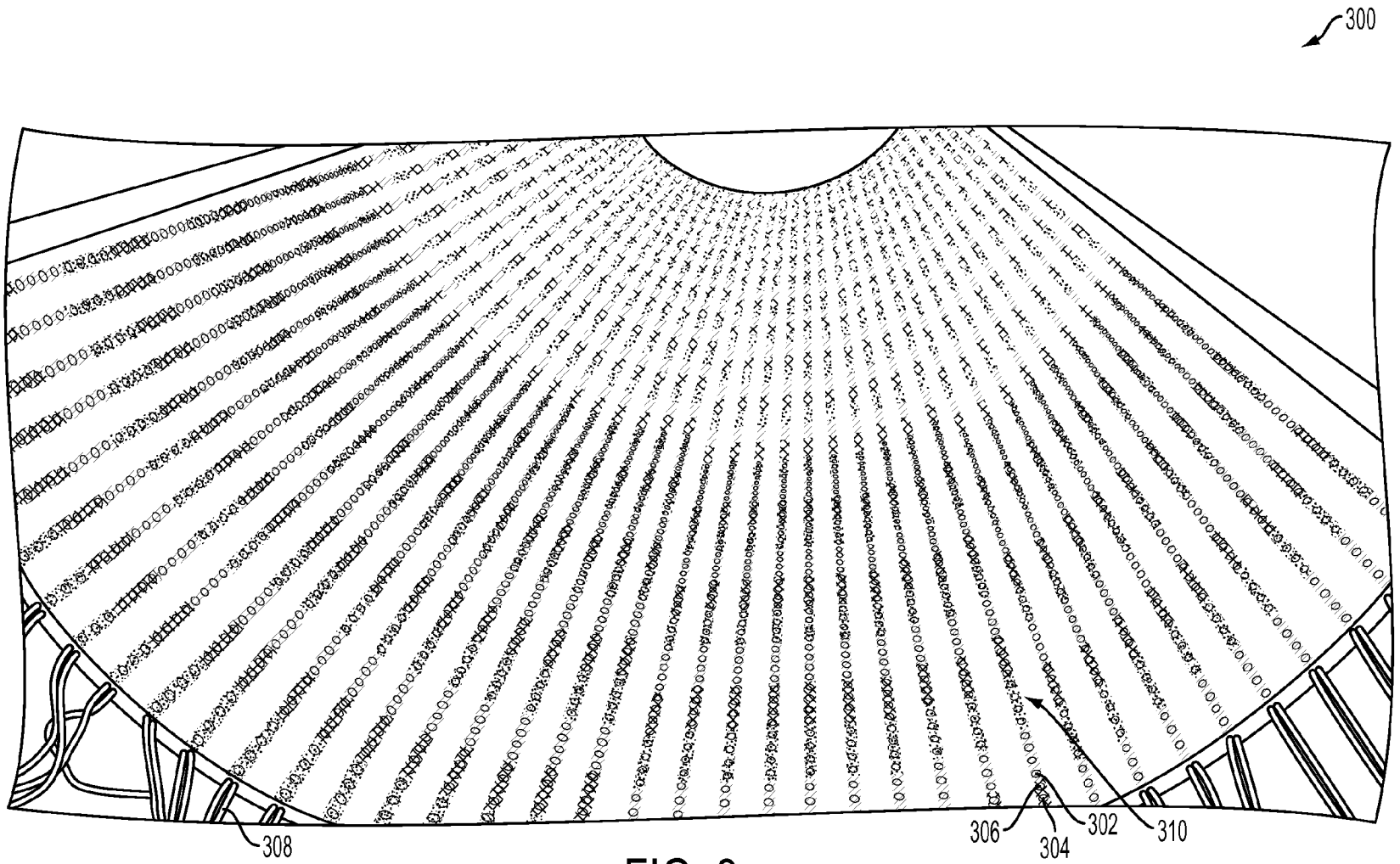
FIG. 3 shows an inner perspective view of a waterslide clam-shell section capable of visual illumination via illuminated LED light strips according to an embodiment of the present invention.

For example, turning next to FIG. 3, an inner perspective view of a waterslide clam-shell section 300 capable of visual illumination via illuminated light strips (e.g., LED light strips) is shown. The clam-shell section 300 includes a plurality of LED light strips 310 positioned adjacent to one another circumferentially around the clam-shell section 300. Each of the plurality of LED light strips 310 contains a plurality of LED lights (e.g., first LED or light 302, second LED or light 304, and third LED or light 306) that may be independently illuminated in a variety of different colors. A controller (e.g., from a connected computer system through wiring 308) may control the color, color intensity, and/or illumination of each of the plurality of LED lights in the plurality of LED light strips 310. Thus, as a rider rides on or adjacent to the waterslide clam-shell section 300, the rider can view any of a variety of illuminated shapes, colors, or other images. In one embodiment, the lights may be made to have the appearance of moving or shifting along the waterslide, for example, by illuminating a light (e.g., the first LED or light 302) by a first color, then, sequentially, illuminating an adjacent light (e.g., the second LED or light 304) by the first color, then, sequentially, illuminating an adjacent light (e.g., the third LED or light 306), and etc. By controlling the timing of lighting sequence, the appearance of moving with various speeds may be created.

Figure 4:
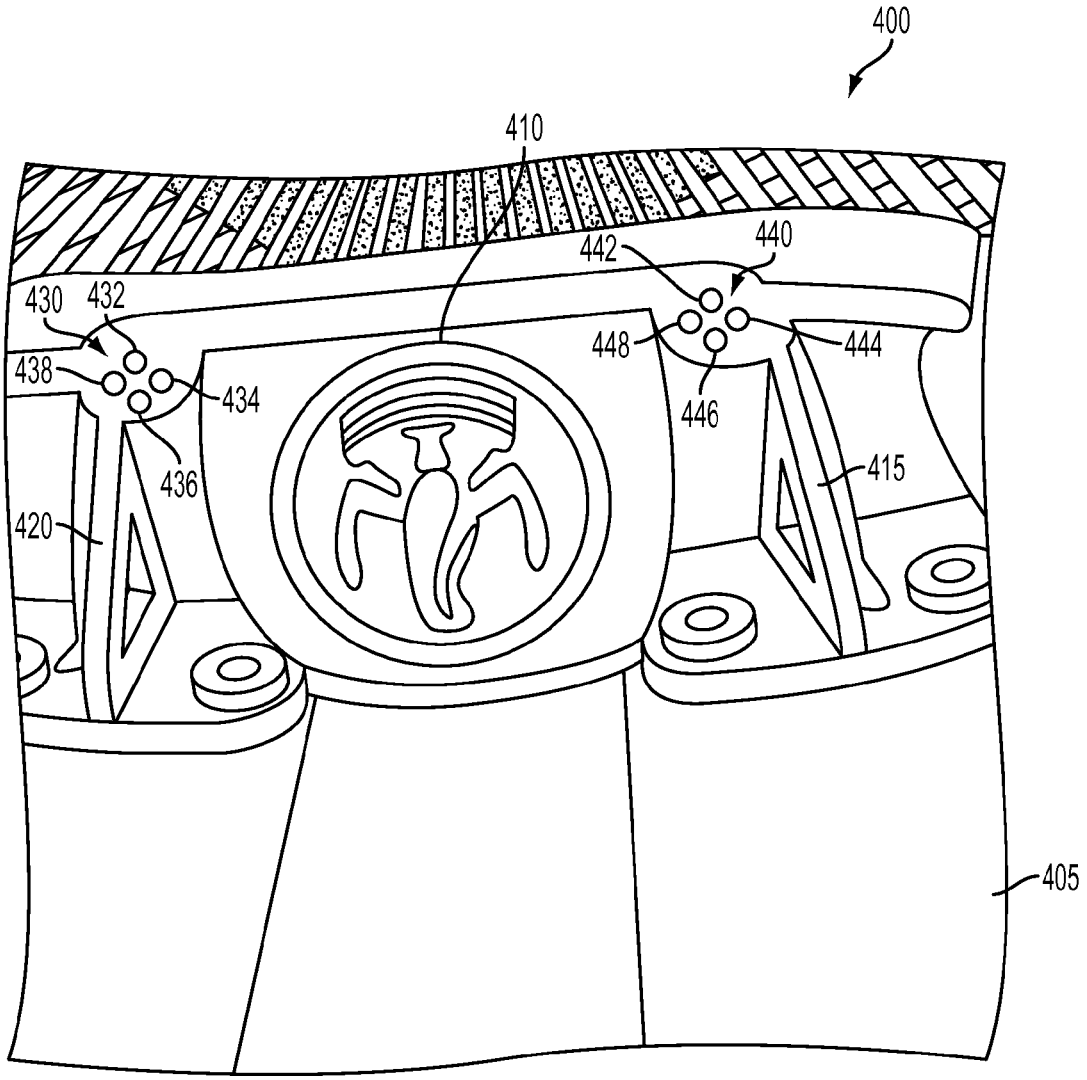
FIG. 4 shows a rider perspective view of a portion of a slideboard for riding on a waterslide capable of visual illumination according to an embodiment of the present invention.

FIG. 4 shows a rider perspective view of a portion of a slideboard 400 for riding on a waterslide capable of visual illumination. The waterslide and/or slideboard 400 may include features that are the same as or similar to those previously described. The slideboard 400 includes a supporting surface 405 configured to support all or a portion of a rider's body (e.g., a rider's torso) and a first handlebar, member, or contact point 415 and a second handlebar, member, or contact point 420 that the rider may grip, hold onto, or otherwise put all or a portion of their hands or other body part therethrough while using the slideboard 400 to ride down the waterslide. Adjacent to the first handlebar, member, or contact point 415 is a first grouping 440 of interactive elements or mechanisms (e.g., illustrated as buttons). For example, as shown, four buttons may be used, each button corresponding to a different color. A first button 442 (e.g., yellow), a second button 444 (e.g., red), a third button 446 (e.g., green), and a fourth button 448 (e.g., blue) may be configured to be pressed by the rider (e.g., via the rider's thumb) using his/her hand that is also gripping the first handlebar, member, or contact point 415. The first grouping of interactive elements 440 is configured to interact with (e.g., via wireless communication) the controller controlling the visual illumination. In an alternative embodiment, the first grouping 440 of interactive elements may interact with a local controller, processor, memory, or etc. that is not located remotely from the slideboard 400 rather than, or in addition to, communication with a remote controller or other electronic system or device of the waterslide. As discussed in greater detail below, pressing one or more of the buttons in the first grouping 440 of buttons may be in response to visual illumination of the waterslide and can cause a modification of the visual illumination or other characteristic of the waterslide.

Similarly, adjacent to the second handlebar, member, or contact point 420 is a second grouping 430 of interactive elements or mechanisms (e.g., illustrated as buttons). For example, as illustrated, four buttons may be used, each button corresponding to a different color. A first button 432 (e.g., yellow), a second button 434 (e.g., red), a third button 436 (e.g., green), and a fourth button 438 (e.g., blue) may be configured to be pressed by the rider (e.g., via the rider's thumb) using his/her hand that is also gripping the second handlebar, member, or contact point 420. The second grouping of interactive elements 430 is similarly configured to interact with (e.g., via wireless communication) the controller controlling the visual illumination. In an alternative embodiment, the second grouping 430 of interactive elements may interact with a local controller, processor, memory, or etc. that is not located remotely from the slideboard 400 rather than, or in addition to, communication with a remote controller or other electronic system or device of the waterslide. As discussed in greater detail below, pressing one or more of the buttons in the second grouping 430 of buttons may be in response to visual illumination of the waterslide and can cause a modification of the visual illumination or other characteristic of the waterslide and/or the slideboard 400 (e.g., the slideboard 400 may emit a sound and/or vibration that can be sensed by the rider).

The first grouping 440 and the second grouping 430 of buttons may be configured to operate in sync with one another. For example, if a visual illumination on the waterslide shows a moving yellow band of light towards the rider, the rider may press either the first button 442 of the first grouping 440 of buttons or the first button 432 of the second grouping 430 of buttons in order to adequately or accurately provide the desired user input to modify the visual illumination on the waterslide. In other embodiments, the first grouping 440 and the second grouping 430 of buttons may not be configured to operate in sync with one another. For example, a yellow band of light on the left-hand side of the waterslide may only be adequately or accurately responded to by the rider by pressing the first button 432 of the second grouping 430 of buttons while a yellow band of light on the right-hand side of the waterslide may only be adequately or accurately responded to by the rider by pressing the first button 442 of the first grouping 440 of buttons.

Any of a variety of numbers of buttons, sizes of buttons, button placement, numbers of groups, and/or corresponding visual distinguisher (e.g., colors, shapes, images, etc.) may be used for the buttons on a slideboard in alternative embodiments. In one example, only one button may be used, such as in a center portion 410 of the slideboard 400. The buttons may interact with any of a variety of components, such as a transmitter, that is built into the slideboard 400 (e.g., encased in the center portion 410) in order to protect the components from contact with water that is on the waterslide. In one embodiment, the transmitter may interact (e.g., wirelessly communicate) with other electronic or computing components that cause modifications to the visual illuminations and/or other stimuli or statistics associated with the water slide or with the user. In an alternative embodiment, interactive components that may be manipulated by a rider may not transmit to remote devices or systems, but may instead store such manipulation information (e.g., timing of a button press, etc.) locally on equipment connected with the slideboard 400.

Figure 5A:
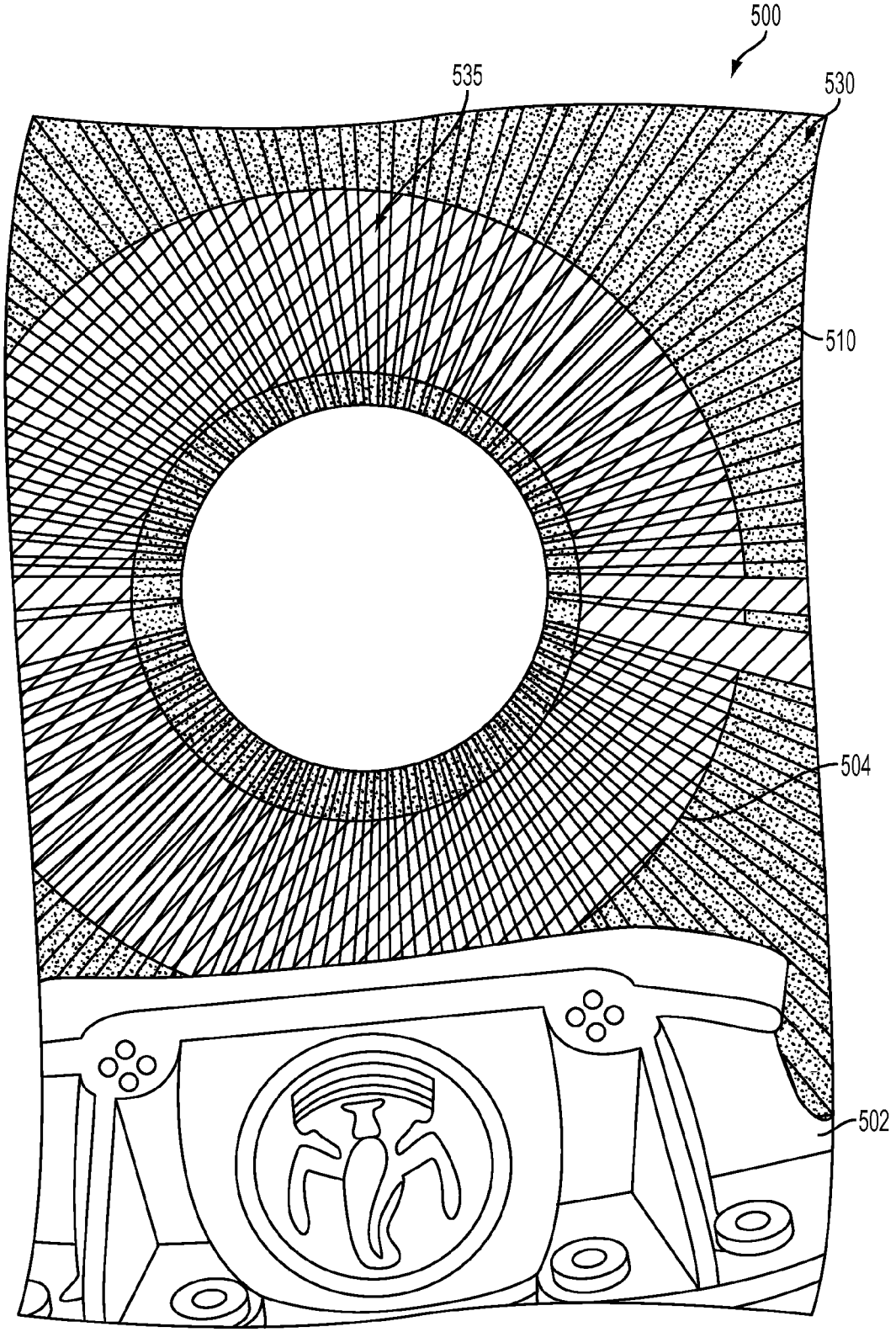
FIG. 5A shows a rider perspective view of a waterslide clam-shell capable of a first visual illumination according to an embodiment of the present invention.
Figure 5B:
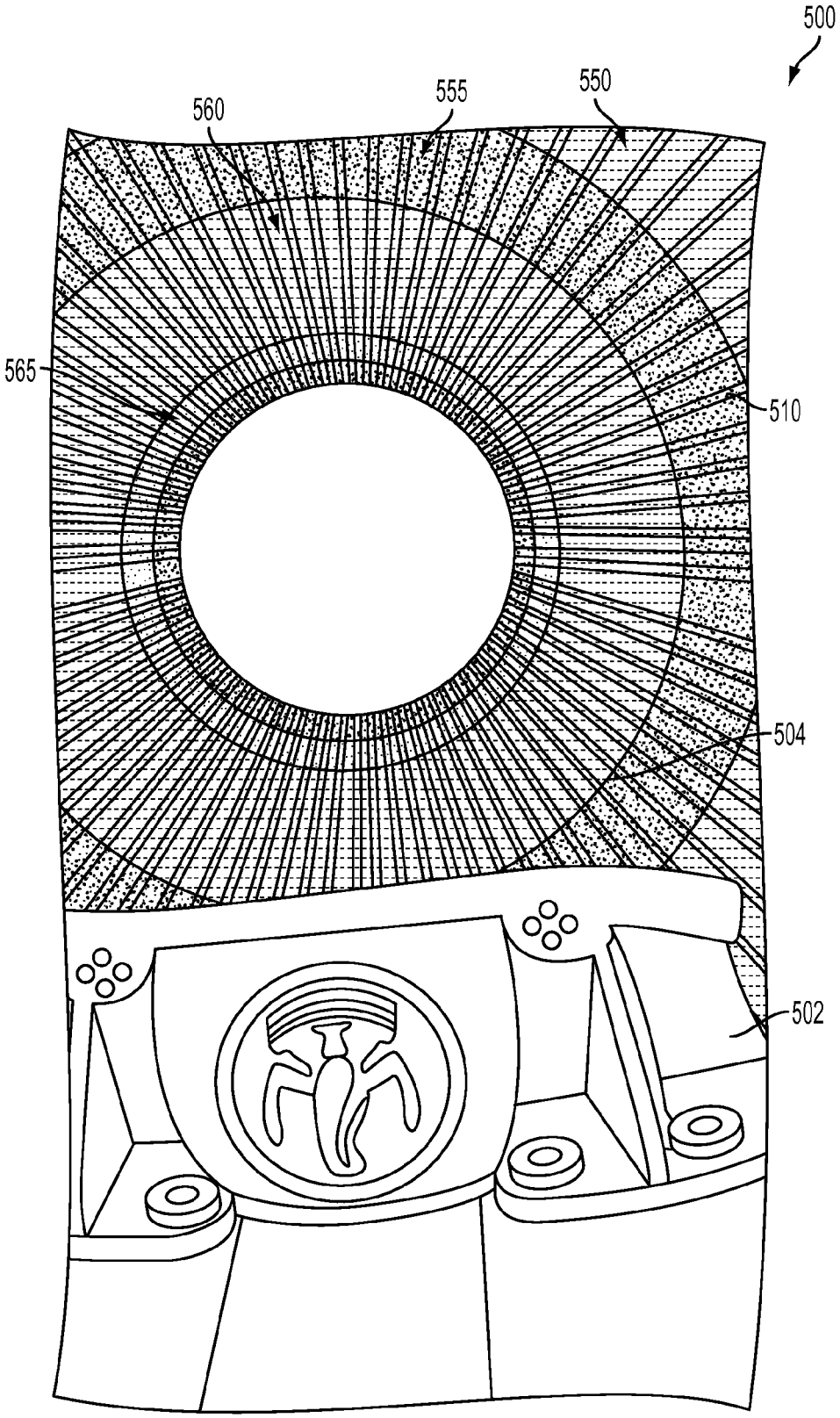
FIG. 5B shows a rider perspective view the waterslide clam-shell capable of a second visual illumination according to an embodiment of the present invention.

FIGS. 5A and 5B shows a rider perspective view of a waterslide 500 capable of a first visual illumination and a second visual illumination for the purposes of providing a game or sense of rider skill as a rider travels on the waterslide 500. The waterslide 500 may include features that are the same as or similar to those previously described. As illustrated, a rider is configured to use a slideboard 502 or other ride vehicle to slide down a sliding surface 504 of the waterslide 500. The slideboard 502 includes one or more interactive elements (e.g., buttons) that may be manipulated (e.g., pressed) and that correspond to a target that is shown to the rider via the visual illumination displayed by the waterslide 500. The same as or similar to the previous discussions, the waterslide 500 may incorporate a plurality of lights 510 (e.g., LEDs) that are arranged in strips along the waterslide 500 for creating such visual illuminations to the rider.

In one example, as shown, the plurality of lights 510 can visually display to the rider a first presentation 530 (e.g., blinking or flashing white lights that "sparkle" and appear to move and/or rotate around the waterslide 500). The plurality of lights 510 can also visually display to the rider a second presentation 535 (e.g., a colored band of light that moves or shifts towards and/or away from the rider) as the rider slides down the waterslide 500. FIG. 5B shows the waterslide 500 using the plurality of lights 510 to visually display to the rider a third presentation 550, a fourth presentation 555, a fifth presentation 560, and a sixth presentation 565. These presentations (550, 555, 560, 565) form a plurality of circles or bands of light that move or shift along the waterslide 500 as the rider slides down the sliding surface 504 of the waterslide 500 on the slideboard 502.

Varying rates of speed may be used for the movement of such bands of light in order to provide a faster-feeling or slower-feeling ride experience. For example, although the rider may only be physically traveling at 5 mph down a water slide, the bands of light may be configured to move or shift towards the rider at 15 mph, causing a sensation of speed at 20 mph for the rider. Similarly, although the rider may be physically traveling at 10 mph down a water slide, the bands of light may be configured to move or shift away from the rider at 5 mph, causing a sensation of speed at 5 mph for the rider. Dizzying effects may be created by strobing, flashing, rotating, or otherwise presenting images, colors, shapes, or patterns to the rider with disorientating characteristics.

Figure 7:
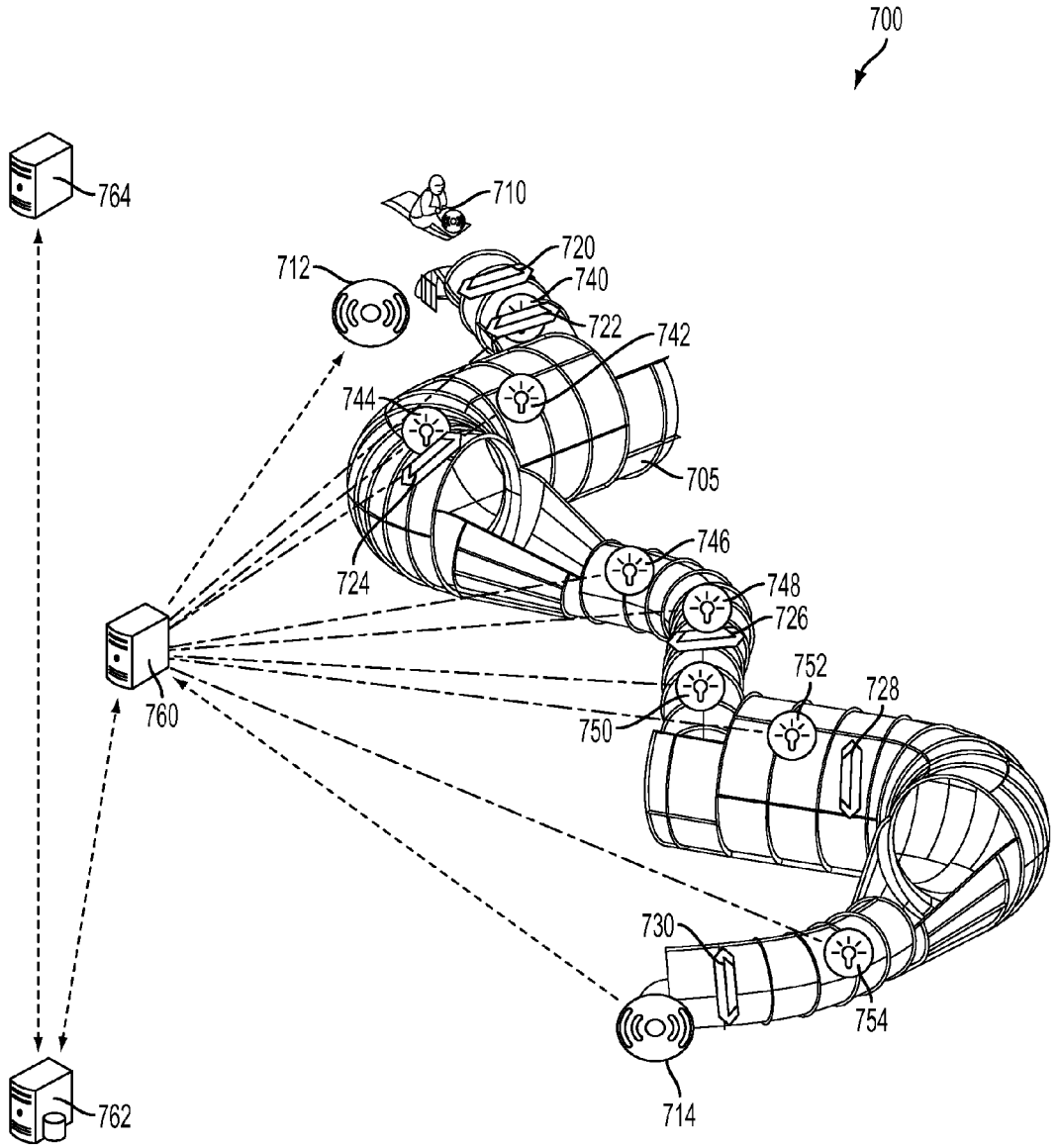
FIG. 7 shows a perspective view of an amusement attraction for determining a position of a rider according to an embodiment of the present invention.

The same as or similar to previous discussions, a rider's skill or reflexes may be tested on the waterslide 500 by asking the rider to appropriately provide user input via interactive elements (e.g., buttons) on the slideboard 502 in response to visual illuminations of the waterslide 500 displayed via LED strips. In one embodiment, one or more bands of colors may be configured to shift towards a rider at a predetermined speed or rate and the rider is configured to respond by manipulating one or more interactive elements when the one or more bands of colors is within a predetermined distance from the rider. For example, the rider may press a red button when a red band of color is within a predetermined distance from the rider and a blue button when a blue band of color is within a predetermined distance from the rider. This distance from the rider may be any of a variety of desired distances, for example, based upon the speed and location of the rider and/or ride vehicle along the waterslide. Thus, the rider location may be tracked along the waterslide in order to determine this predetermined distance for interactive element manipulation (e.g., FIG. 7 shows one possible way of tracking a user to determine such predetermined distances from the rider). In another embodiment, a target (e.g., a light or group of lights) may illuminate (e.g., after previously not being illuminated) so that the user may press a corresponding button when within a predetermined distance to the target.

In another embodiment, different colors, shapes and/or patterns may be configured to be displayed and the rider is configured to press a corresponding button when the different color, shape, and/or pattern is seen. The further away that a color, shape and/or pattern is located from the rider on the waterslide 500 may result in different rewards (e.g., higher points). In another embodiment, different colors, shapes, and/or patterns may be configured to move towards or away from the rider at different speeds to simulate a sense of speed for the rider, either in response to previous rider input or automatically. For example, if the rider adequately responds by pressing a button to a previously displayed target, various colors, shapes, and/or patterns may be caused to rush towards the rider to simulate a "speed boost" and provide the rider with a thrilling reward experience in response to the user input.

Likewise, if the rider does not adequately respond by pressing a button to a previously displayed target, various colors, shapes, and/or patterns may be caused to rush away from the rider to simulate a "speed reduction" and not reward the rider with the simulated rush of speed. Similarly, bursts or "explosions" of illuminated colors, shapes, and/or patterns may be displayed in response to user input that do not appear to animate towards or away from the rider in response to rider input in order to give feedback to the rider as to whether the rider correctly manipulated one of the interactive elements. Other elements, in addition to or in replacement of, may provide feedback to the riders, such as sound, vibration, etc.

In yet another embodiment, bands of light or other colors, shapes, and/or patterns may be "chased" by the rider as the rider travels down the waterslide 500. For example, various speed boosts or speed reductions, the same or similar to those described above, may give the sensation to the rider of chasing after a particular object as the rider travels on the waterslide 500 and responds to targets with rider input. Adequate rider input responses (e.g., correct button presses) may bring the rider closer to the band of light or other color, shape, and/or pattern that is being chased while inadequate rider input responses (e.g., failing to correctly or timely press a button) may result in the rider getting further away from the band of light or other color, shape, and/or pattern that is being chased.

Any of a variety of visual illuminations may be displayed and/or moved and/or changed along the waterslide 500 as a rider travels down the waterslide 500. Themes may be setup (e.g., under the ocean, raging rivers, etc.) wherein not only may objects that correspond to such themes (sea mammals, fish, etc.) get displayed for the rider, but the sense of speed may be altered depending upon the sensation desired for the rider at a particular portion of the waterslide 500. For example, if a raging river theme is chosen, objects may be configured to rapidly move towards the rider in order to provide an increased sense of speed for the rider. Such a sense of speed for a rider may be continually modified based upon the rider input, the experience getting increasingly faster as the rider sequentially inputs adequate rider input responses and/or slowing down as the rider begins missing adequate rider input responses.

Any of a variety of audible or other sensory or general characteristics or features may be enabled in addition to, or in place of, visual illuminations (e.g., entering a "cave-themed" portion of the waterslide 500 may result in the LEDs being turned off, but sound effects of wind or cave creatures may be played with vibration of the slide and/or slideboard to simulate rapids, scented air sprayed in the vicinity of the rider, water jets or geysers sprayed onto the rider or onto the waterslide 500, and/or any of a variety of other such features. Other examples of characteristics or features may include modifying temperature, moisture content, opacity or transparency of one or more portions of the waterslide, physical actuation of slide portions or components (e.g., ramps, dips, branching slide paths that open or close, etc.)

Figure 6:
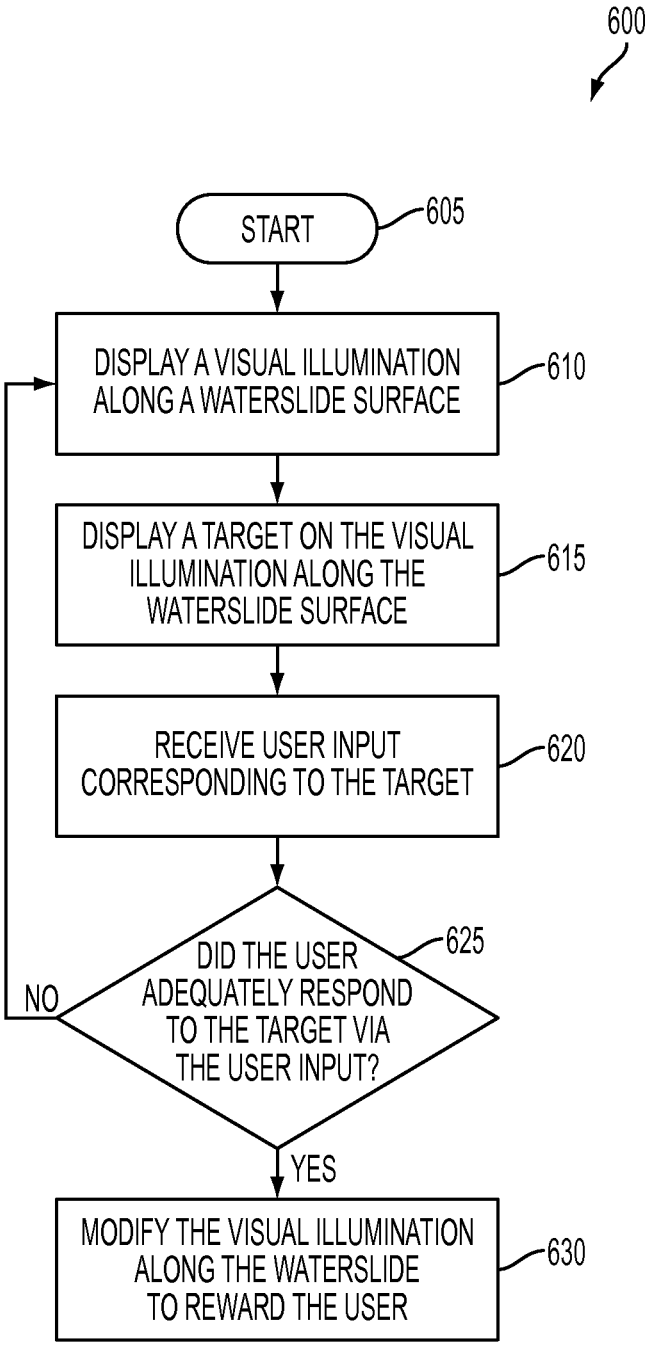
FIG. 6 shows a flowchart of a method for modifying a visual illumination of a waterslide in response to user input according to an embodiment of the present invention.

FIG. 6 shows a flowchart 600 of a method or process for modifying a visual illumination of a waterslide in response to user input. The waterslide may include features that are the same as or similar to those previously discussed. At step 605, the process begins, for example, upon initiation of a run down the waterslide by a user. This initiation may begin automatically upon sensing that a rider has begun decent down the waterslide or is located at a particular location along the waterslide (e.g., using lasers, weight sensors, or other sensors to determine a position and/or speed of a rider. In an alternative embodiment, the initiation may occur in response to an operator of the ride indicating that a rider is beginning the descent down the waterslide (e.g., by pressing a start button).

At step 610, a visual illumination is displayed along a surface of the waterslide for viewing by the rider. As previously discussed, such illuminations may be any of a variety of colors, shapes, patterns, themes etc. At step 615, a target is displayed on or via the visual illumination along the waterslide surface. As previously discussed, the target may be any of a variety of colors (e.g., a color band), shapes, patterns, objects, etc. and can be static or animating or moving towards or away from the rider.

At step 620, user input is received from the rider in response to the target displayed at step 615. For example, if the target is a band or illumination of a particular color, the rider may correspondingly press a button having the same color when the band of the particular color is within a predetermined distance from the rider. The user input may be obtained in a variety of alternative manners in alternative embodiments, for example, by positioning a tag (e.g., an RFID tag) within a predetermined distance from a sensor, sensing contact by the rider or ride vehicle with a particular portion or area of the waterslide, etc. In another example, user input may be obtained via any interactive element that can be moved and/or otherwise manipulated by a rider. In embodiments where the waterslide is configured to allow sliding motion of the rider thereon without any additional ride vehicle, the interactive element may be worn, held, or otherwise manipulated by the rider. Alternative embodiments may couple the interactive element with a ride vehicle (e.g., mounted or connected to the ride vehicle, embedded within the ride vehicle, etc.), held by the rider, worn by the rider, or any other manner that allows the rider to manipulate (either by physically pressing, switching, sliding, etc. a component or by moving a tag within a particular distance of a sensor).

At step 625, it is determined whether the rider of the waterslide adequately responded to the target displayed in step 615, via the user input received in step 620. For example, if the target was a band or illumination of a particular color, an adequate response may have been by pressing the button having the same color when the band of the particular color was within a predetermined distance from the rider. If the rider did not adequately respond per the programming of the waterslide system, operation continues back to step 610 where the displaying of visual illuminations and/or targets is repeated until the rider has finished traveling down the waterslide or otherwise is no longer within the portion of the waterslide capable or presenting visual illuminations. However, if the rider did adequately respond per the programming of the waterslide system, operating continues to step 630.

At step 630, the visual illumination along the waterslide is modified to reward the user for adequately responding to the previous target displayed at step 615. In one example, this may involve displaying one or more colors, shapes, and or patterns to the user, indicating successful user input. In another example, this may involve increasing the rate of speed that the visual illuminations and/or targets are moved towards the rider, providing a thrilling sense of increased speed and/or difficulty to the rider. Any of a variety of rewards may be provided in an alternative embodiment, either via visual illuminations or otherwise. For example, if a user has associated a "score" or accumulation of points based upon successful user input in response to targets, adequate response may result in accumulation of additional points in place of, or in addition to, modification of the visual illumination.

Still other embodiments of rewards for successful user input may include, physically manipulating portions of the waterside slide path (e.g., raising or lowering portions of the sliding surface, turning on or off jets or flows of water, opening or closing branching pathways on the waterslide for sending a rider down different waterslide paths depending upon the user input, etc.) Any combination of visual stimulus, audible stimulus, or other features, such as vibration of the slideboard or other ride vehicle portion, may be used for providing responses to the user input received at step 620.

Optionally, if the user fails to adequately respond to the target displayed at step 615, the programming of the waterslide system may loop back to step 610 and test the rider's response again.

As previously discussed, a distance to a rider or rider position in general along a waterslide or other amusement attraction may be desirably determined. FIG. 7 illustrates one embodiment for determining a location of a rider 710 as the rider traverses an amusement attraction 700. The amusement attraction 700 may be made up of a plurality of segments 705 (e.g., flume segments) that connect with one another (e.g., via flanges) to form a slidepath for the rider 710 to traverse, either on a ride vehicle or without.

A first communication point 712 that is linked (e.g., wirelessly or wired) or otherwise capable of communication with a game system 760 (e.g., a computer or other electronic system or device) is located near or adjacent to an entrance point of the amusement attraction 700 may communicate with the rider 710 and/or ride vehicle to establish an initial datapoint establishing a start time for the user to begin descent down the amusement attraction 700. Other data may additional or replaceably be transferred via the communication point 712 (e.g., user profile information, user statistics, etc.). A plurality of synchronization points (720, 722, 724, 726, 728) are disposed along the slidepath of the amusement attraction 700 and provide additional data for tracking the location of the rider 710 along the amusement attraction 700.

For example, the synchronization points (720, 722, 724, 726, 728) may be magnetic in nature such that when a user passes within a predetermined distance of a particular synchronization point (720, 722, 724, 726, 728), data indicating that the rider is in such vicinity is triggered and/or relayed to the game system 760. This data alone, or in conjunction with other information (e.g., an elapsed time determined from a previous synchronization point (720, 722, 724, 726, 728) and/or communication point 712 may be used to determine certain characteristics, such as velocity, of the rider. In this fashion, the rider 710 may be tracked and/or estimates as to where the rider 710 will be located along the amusement attraction 700 at a known time in the future may be determined. Using these determinations, various gaming possibilities (e.g., asking a user to manipulate an interactive element when within a predetermined distance of a target (740, 742, 744, 746, 748, 750, 752, 754)) may be incorporated into the amusement attraction, for example, as previously discussed. A final communication point 714 that is linked (e.g., wirelessly or wired) or otherwise capable of communication with the game system 760 (e.g., a computer or other electronic system or device) is located near or adjacent to an exit point of the amusement attraction 700 may communicate with the rider 710 and/or ride vehicle to determine and/or relay information to the game system 760 for final display or calculation of rider statistics (e.g., upon a scoreboard).

The game system 760 may interact with memory (e.g., a database 762) that stores user data in order to operate the amusement attraction 700 according to one or more characteristics of a particular rider 710 (e.g., making successful user interactions in response to the targets (740, 742, 744, 746, 748, 750, 752, 754) easier or harder based upon age of the rider, number of times the rider has ridden the amusement attraction 700, a selected skill level chosen by the rider 710, etc.) A registration station or system 764 may be provided for users to input such characteristics and/or any other information that may be stored in the database 762.

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A waterslide comprising:

a slide having a surface for supporting a flow of water thereon;

at least one light strip connected around at least a portion of the slide and configured to illuminate;

a ride vehicle configured to support at least a portion of a rider and travel on the surface of the slide via the flow of water;

a button connected with the ride vehicle and configured to be pressed by the rider in response to the illumination of the at least one light strip; and a reward component configured to be activated if the rider presses the button within a predetermined amount of time from the illumination of the at least one light strip.

2. The waterslide of claim 1 wherein the at least one light strip comprises a plurality of LED strips.

3. The waterslide of claim 2 wherein the plurality of LED strips are configured to illuminate a band of color to the rider as the rider and the ride vehicle travel on the surface of the slide via the flow of water.

4. The waterslide of claim 3 wherein the band of color is configured to move towards or away from the rider by controlling the plurality of LED strips.

5. The waterslide of claim 1 wherein the reward component comprise changing the illumination of the at least one light strip.

6. The waterslide of claim 1 wherein the reward component comprises increasing a score associated with the rider.

7. An amusement attraction comprising:

a slide having a surface for supporting a rider;

at least one light strip coupled around at least a portion of the slide and configured to illuminate;

a button configured to be pressed by the rider in response to the illumination of the at least one light strip; and a reward component configured to be activated to reward the rider if the rider presses the button within a predetermined amount of time from the illumination of the at least one light strip.

8. The amusement attraction of claim 7 wherein the at least one light strip comprises a grouping of LEDs.

9. The amusement attraction of claim 7 further comprising a sync point connected with the slide.

10. The amusement attraction of claim 9 wherein the sync point is magnetic.

11. The amusement attraction of claim 10 wherein the sync point is configured to determine a location of the rider along the slide.

12. The amusement attraction of claim 11 wherein the at least one light strip is configured to change illumination in response to the pressing of the button.

13. The amusement attraction of claim 11 wherein the reward component is configured to be activated based on the determined location of the rider along the slide.

* * * * *